US005172615A

United States Patent [19]

Albrecht

[11] Patent Number: 5,172,615

[45] Date of Patent: Dec. 22, 1992

[54] INTERNAL WRENCH

[76] Inventor: David E. Albrecht, 1383 Granary Rd., Blue Bell, Pa. 19422

[21] Appl. No.: 671,536

[22] Filed: Mar. 19, 1991

Related U.S. Application Data

[63] Continuation-in-part of Ser. No. 498,818, Mar. 23, 1990, abandoned.

[51] Int. Cl.[5] ..... B25B 15/00

[52] U.S. Cl. ..... 81/436; 411/2; 81/185; 81/461

[58] Field of Search ..... 81/436, 461, 124.2, 81/185; 411/2; 285/39, 2–4

[56] References Cited

U.S. PATENT DOCUMENTS 3,241,408 3/1966 McCauley ..... 81/436
3,460,428 8/1969 Charles ..... 411/2
3,875,829 4/1975 Evans et al. ..... 81/185
4,149,434 4/1979 Wilson ..... 411/2 X
4,480,513 11/1984 McCauley et al. ..... 81/436
4,584,914 4/1986 Hall et al. ..... 81/461 X

FOREIGN PATENT DOCUMENTS 349938 10/1960 Switzerland ..... 81/436

*Primary Examiner*—James G. Smith
*Attorney, Agent, or Firm*—Frank A. Follmer

[57] ABSTRACT

An internal wrench has a body having an internal hole of a polygon shape and an outer surface of a polygon shape which conforms to the internal wrenching surface of the part to be wrenched. The wrench body is provided with a shoulder for locating the wrench in a proper drive engagment position.

14 Claims, 3 Drawing Sheets

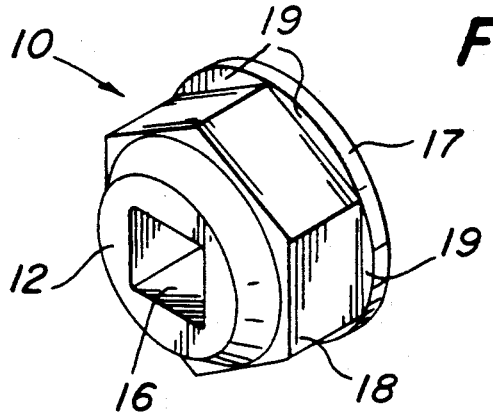
FIG. 1
FIG. 2
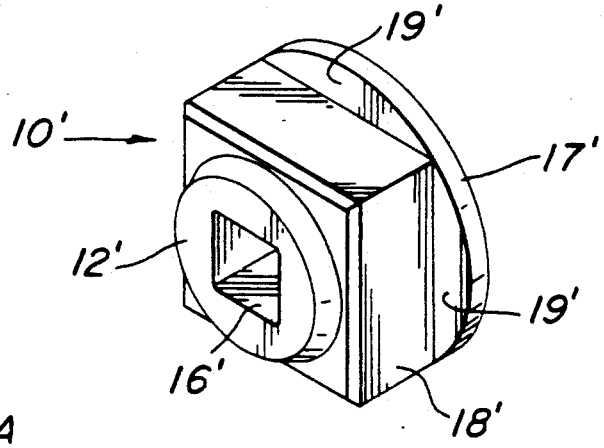
FIG. 3
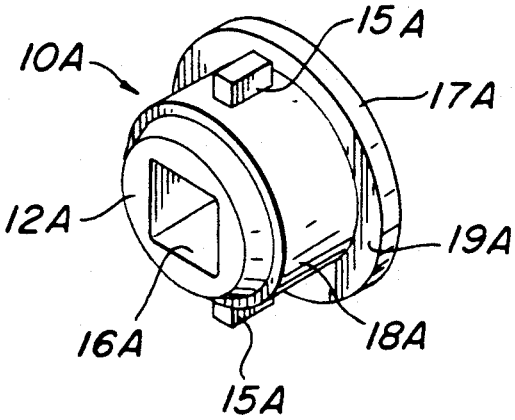
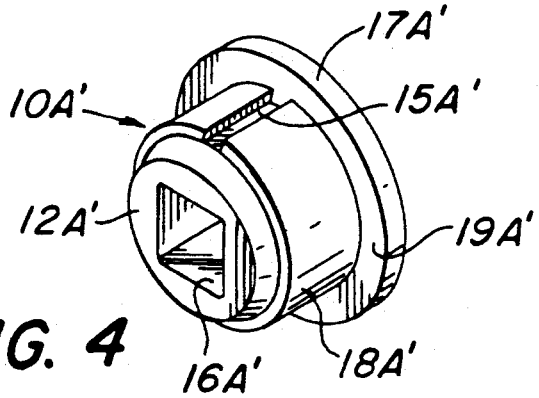
FIG. 4

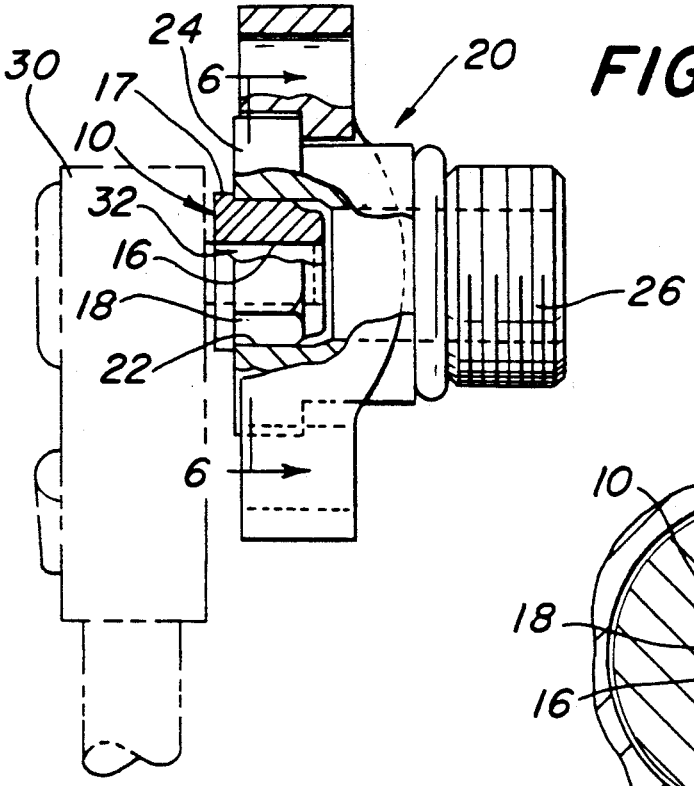
FIG. 5
FIG. 6
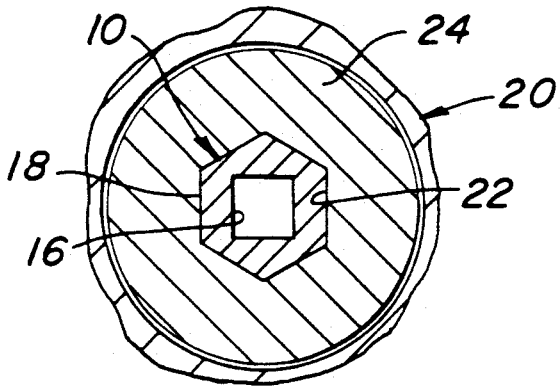
FIG. 7
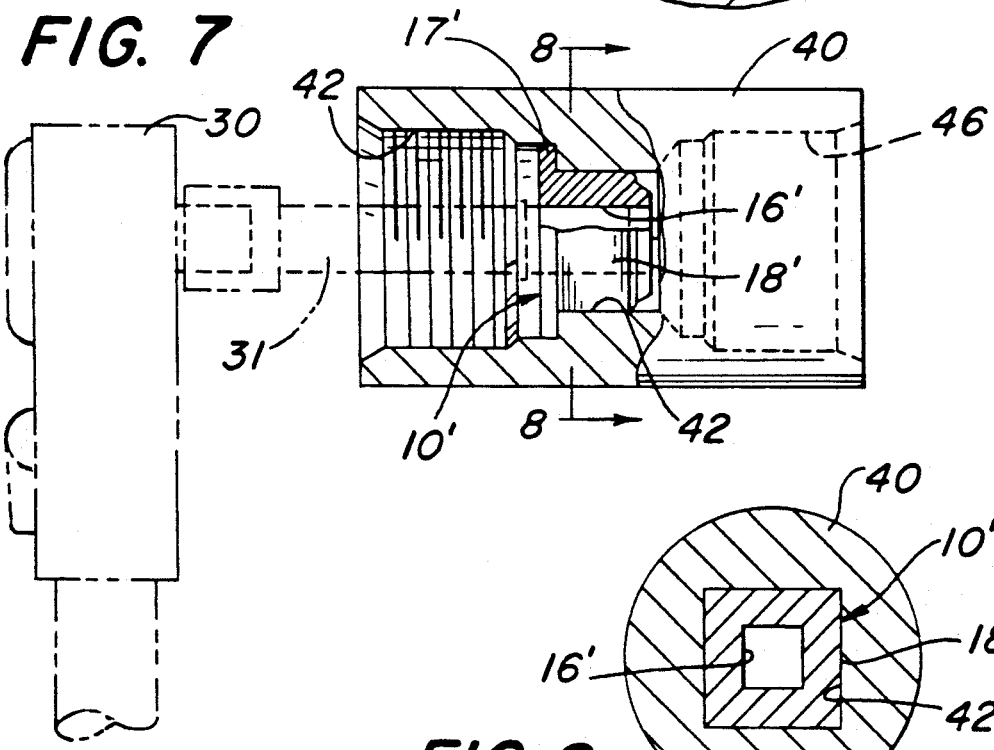
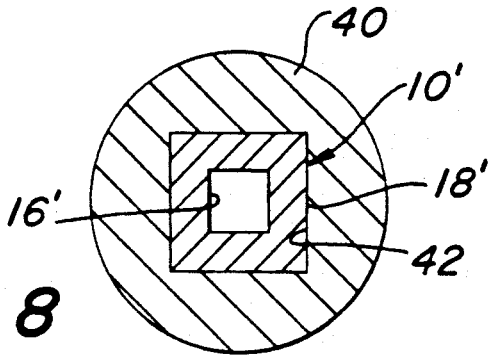
FIG. 8

INTERNAL WRENCH

RELATED U.S. APPLICATION DATA

This application is a continuation-in-part of Ser. No. 498,818, filed Mar. 23, 1990, now abandoned.

BACKGROUND AND SUMMARY OF THE INVENTION

This invention relates generally to wrenches and, more particularly, to internal wrenches for use in the internal wrenching of mechanical joints.

Internal polygon shapes have been used in the past as a means of tightening mechanical fasteners, such as bolts, etc. A common type of these internal tightening means is the hexagonal shape used in the head of a bolt. These bolt type fasteners generally use solid hexagonal bar-like wrenches, known as Allen wrenches, to tighten and loosen them. Other polygonal shapes, such as a square, have also been used as a means to tighten mechanical fasteners and, in fact, except for a circle, any shape can be employed, including elipses, splines, etc.

Further, my U.S. Pat. Nos. 4,885,850 and 4,889,369 and pending applications Ser. No. 420,891, filed Oct. 13, 1989, Ser. No. 439,885, filed Nov. 20, 1989, and Ser. No. 448,762, filed Dec. 11, 1989 provide a teaching of how internal wrenching can be effectively employed in fluid flow components.

It is the general object of this invention to provide an internal wrench for use in wrenching mechanical joints, and particularly for use in the internal wrenching of fluid flow components of the above-indicated type.

Another object of the invention is to provide a method of turning a part, such as the fluid flow components in my above-mentioned patents, having an internal wrenching surface by using an internal wrench of the below-described construction.

Briefly stated, the internal wrench in accordance with the invention comprises a wrench body having an internal hole having polygonal shaped sides and of a length to transmit the torque required from the driver. The wrench body also has an outer polygonal shape which conforms to the part to be driven and is of an adequate length to transmit the necessary torque. In addition, there is provided a locating or positioning shoulder for ensuring the proper drive engagement in through-hole or torque limiting and/or drive disarming applications.

More specifically, the internal wrench in accordance with the invention comprises a wrench body having an internal hole centered on a longitudinal axis of the wrench body, said internal hole having a polygon shape providing a plurality of inner surfaces centered on the longitudinal axis and adapted to be contacted by a driver for the wrench. The wrench body has an outer driving surface providing a plurality of outer surfaces adapted to contact the internal wrenching surface of the part to be wrenched. The wrench body also includes a shoulder formed at one end thereof extending radially outwardly of the outer surfaces of the wrench body for contacting the part to be wrenched to limit the insertion of the wrench body into the parts internal wrenching surface to thereby locate the wrench in a driving position. The internal surfaces of the internal hole have surface portions which, along with the outer surfaces of the driving surface, extend axially from the radial plane of said shoulder at one end of the wrench body a substantial distance toward the other end of the wrench body. The surface portions of the internal surfaces are contained radially within the outer surfaces along a common portion of the longitudinal axis so as to be longitudinally coaxial therewith so that during the wrenching of a part by a driver in driving contact with said surface portions of said inner surfaces, wrenching forces are transmitted directly radially outwardly from said surface portions of said inner surfaces of said internal hole to said outer surfaces of said driving surface.

In the method in accordance with the invention of internal wrenching a component of a mechanical joint including a part having an internal wrenching surface, the first step is to provide an internal wrench of the type described above. Also in accordance with the method there is included the steps of inserting the internal wrench in a wrenching position by placing the outer surfaces of the wrench body in driving contact with the internal wrenching surface of said part for driving the same during wrenching and by placing the shoulder of the wrench body in contact with said part to limit the insertion of the wrench body into the part's internal wrenching surface to thereby locate the wrench in a driving position, placing the drive portion of a drive wrench into driving contact with the internal surfaces of said internal hole of the wrench body, and causing a turning movement of the drive portion of the drive wrench to cause a corresponding turning of the internal wrench whereby wrenching forces are transmitted directly radially outwardly from said surface portions of said inner surfaces of said internal hole to said outer surfaces of said driving surface.

BRIEF DESCRIPTION OF THE DRAWINGS

FIGS. 1, 2, 3 and 4 are isometric views of four embodiments of an internal wrench in accordance with the invention.

FIG. 5 is an elevational view illustrating the use of the internal wrench shown in FIG. 1.

FIG. 6 is a sectional view taken on line 6—6 of FIG. 5.

FIG. 7 is an elevational view illustrating the use of the internal wrench shown in FIG. 2.

FIG. 8 is a sectional view taken on line 8—8 of FIG. 7.

DETAILED DESCRIPTION OF THE PREFERRED EMBODIMENTS

Figure 9:
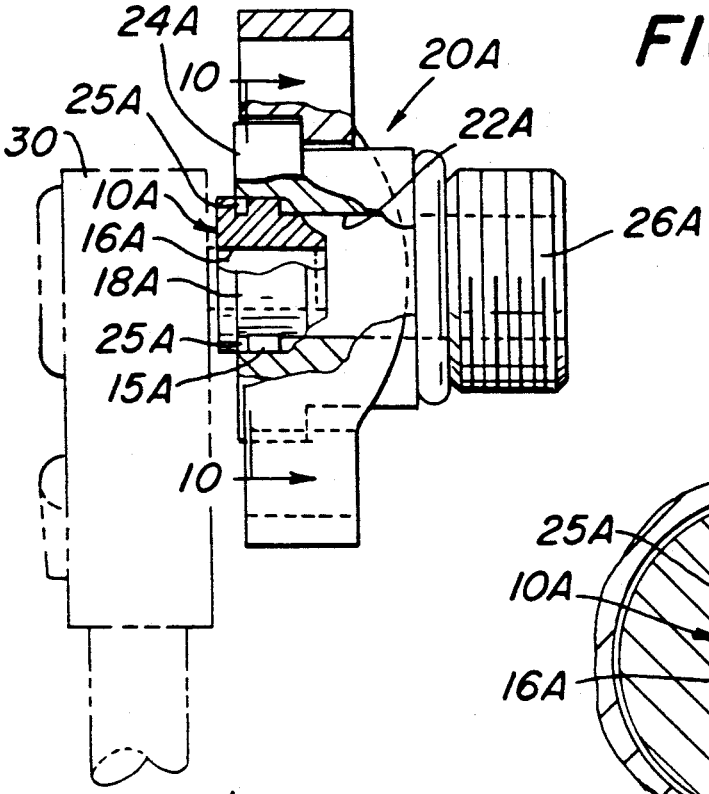
FIG. 9 is an elevational view illustrating the use of the internal wrench shown in FIG. 3.

FIG. 1 shows an internal wrench in accordance with the invention for use in turning a part having an internal wrenching surface formed of a hexagonal recess. Wrench 10 comprises a wrench body 12 having a longitudinal axis. Wrench body 12 has an internal hole 16 extending longitudinally therethrough and having a polygonal shape of a square to provide four surfaces centered on the body's longitudinal axis. The four surfaces of hole 16 are adapted to be contacted by a square-shaped driver for the wrench 10 during a wrenching operation.

The wrench body 12 has an outer surface portion 18 also formed as a polygon, namely, a hexagonal shape centered on the body's longitudinal axis. The six surfaces of outer surface portion 18 are adapted to contact the part to be driven by the wrench 10, said part having a hexagonal internal recess to which outer surface portion 18 conforms.

The wrench body 12 is provided with a shoulder 17 at one end which has six shoulder faces 19 extending radially outwardly of the six surfaces of outer surface portion 18 of the wrench 10. The faces 19 serve to contact the part to be wrenched when the wrench body 12 is inserted in the internal recess of the part to thereby locate or position the wrench body 12 in the proper driving engagement with said part. This is useful in through-hole or torque limiting and/or drive disarming applications of the type often encountered in the art.

Referring to FIG. 1, and to FIGS. 5 and 6 which show the use of the internal wrench 10 for the wrenching of an adapter fitting, it will be seen that the internal hole 16 provides a plurality of inner surfaces centered on the longitudinal axis of the wrench body 12, which surfaces are adapted to be contacted by the square drive portion 32 of a driver wrench 30 for use in turning wrench 10. Also, the outer surface portion 18 is provided with a plurality of outer surfaces adapted to contact the hexagonal internal wrenching surface 22 of the part (i.e., member 24) to be wrenched. It will also be apparent that the inner surfaces of the internal hole 16 have surface portions which, along with outer surface portion 18, extend axially from the radial plane of the shoulder 17 at one end of the wrench body 12 a substantial distance toward the other end of the wrench body 12. Further, said surface portions of said inner surfaces of internal hole 16 are contained radially within said outer surfaces of outer surface portion 18 along a common portion of the longitudinal axis of the wrench body 12 so as to be axially coaxial therewith so that during the wrenching of member 24 by drive portion 32 of drive wrench 30 in driving contact with said surface portions of said inner surfaces of internal hole 16, wrenching forces are transmitted directly radially outwardly from said surface portions of said inner surfaces of said internal hole 16 to said outer surfaces of outer surface portion 18. The design whereby surface portions of the internal hole are contained within the outer surface portion 18 so that during wrenching the turning forces are transmitted directly radially serves to minimize any longitudinal torsional loading on the internal wrench during use.

It is noted that to maintain balanced stress within the material at all portions of the wrench, the length of outer surface portion 18 does not have to be as great as that of the inner surfaces of the internal hole 16. This is because the torquing forces applied to the inner and outer surfaces are a function of the moment arms, or radial distance from which the force is applied with respect to the longitudinal axis. Therefore, for a given torque, the force applied along the outer surface portion 18 will be less than that applied along the inner surfaces of internal hole 16. Thus, to maintain balanced stress within the material at all portions of the internal wrench 10, it can be seen why it is desirable to have an inner surface longer than the outer surface.

In FIG. 2 there is shown another embodiment of the invention which is essentially the same as the embodiment shown in FIG. 1 wherefore corresponding parts have been given the same reference numerals with primes added. As can be seen from a consideration of these figures, the wrench 10' shown in FIG. 2 differs from that shown in FIG. 1 in that the outer polygon is square instead of a hexagon. Thus, wrench 10' comprises a body 12' having a square inner hole 16' providing four surfaces adapted to be driven by the wrench driver. Body 12' also has an outer surface portion 18' providing four surfaces adapted to contact the part to be driven by the wrench 10'. There is also provided a shoulder 17' providing four shoulder faces 19' for locating the wrench 10' in the proper drive engaging position as discussed above. Internal hole 16' and outer surface portion 18' are centered on the longitudinal axis of body 12'.

FIGS. 5 and 6 show the use of the wrench 10 in accordance with this invention for driving an adapter fitting 20 of the type shown in my U.S. Pat. No. 4,889,369. The adapter fitting 20 has an internal hexagonal wrenching surface 22 in the member 24 as is described in detail in said patent. Briefly, member 24 has a threaded end portion 26 for use in fastening the same to a positive seal threaded outlet connection for a flow component. FIG. 5 illustrates how the locating shoulder means 17 gives the mechanic both the visual assurance and the positive position and feel that the wrench 10 is properly positioned for full and safe torquing of the part to be wrenched. In FIG. 5 there is shown a conventional drive wrench 30 which is provided with a square drive portion 32 which is engaged in the internal hole 16 of the wrench 10 during the wrenching operation.

FIGS. 5 and 6 illustrate the method in accordance with the invention of internal wrenching a component of the mechanical joint wherein the component includes a plurality of internal wrenching surfaces. This method includes the steps of providing an internal wrench 10 having a wrench body 12 as described above. In accordance with the steps of the method of the invention, the internal wrench 10 is inserted into a wrenching position by placing the outer surfaces of outer surface portion 18 in contact with the internal wrenching surfaces 22 of member 24 in a position as shown in FIGS. 5 and 6. In this step, the shoulder 17 is inserted into contact with the member 24 to limit the insertion of the wrench body 12 into the internal wrenching surface 22 of member 24 to thereby locate the internal wrench 10 in a driving position. The method also includes the step of placing the square drive portion 32 of a conventional drive wrench 30 into driving contact with the internal hole 16 of the wrench 10 in a position as shown in FIGS. 5 and 6. With the parts in the position as shown in FIGS. 5 and 6, the drive portion 32 of the drive wrench 30 is turned to produce a wrenching operation wherein the wrench body 12 is turned to thereby transmit wrenching forces directly radially outwardly from the surface portions of the inner surfaces of the internal hole 16 to the driving surfaces of the outer surface portion 18 of the wrench body 12 as described in detail above.

FIGS. 7 and 8 show the use of the wrench 10' in accordance with the invention for driving a fitting similar to the connector shown in my pending application Ser. No. 420,891, filed Oct. 13, 1989. The connector 40 is provided with a central, square wrenching surface 42 which extends between threaded bores 44 and 46 which are adapted to be fastened to adapter fittings like adapter fitting 20 (FIG. 5), as is described in said application. FIGS. 7 and 8 illustrate how the locating shoulder means 17' provides the proper positive positioning of the wrench 10' in the connector 40. It is noted that this positioning is helpful both during assembly and disassembly of the connector 40. As shown in FIG. 7, the drive wrench 30 is provided with an extender 31 having a square drive portion as is conventional for this type of wrenching operation.

Figure 10:
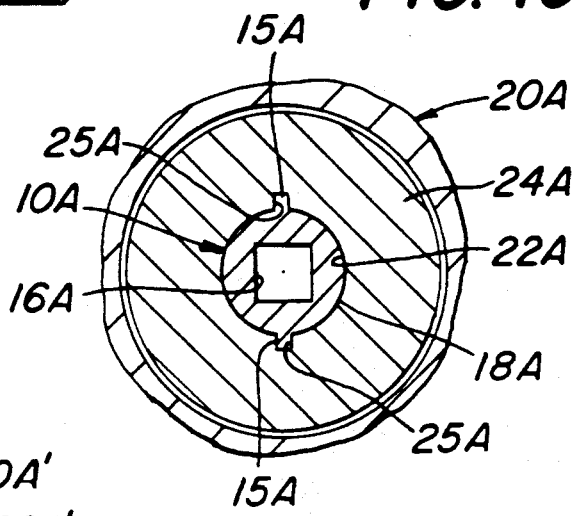
FIG. 10 is a sectional view taken on line 10—10 of FIG. 9.

In FIGS. 3, 9 and 10 there is shown another embodiment of the invention. In these figures, there is provided a wrench 10A similar to the wrenches shown in FIGS. 1 and 2 except that a different external wrenching surface configuration is provided. Wrench 10A comprises a wrench body 12A having a longitudinal axis. Wrench body 12A has a square internal hole 16A extending therethrough to provide four surfaces centered on the body's longitudinal axis. The four surfaces of hole 16A are adapted to be contacted by a square-shaped driver for the wrench 10A during a wrenching operation.

The wrench body 12A has an outer surface portion 18A having a cylindrical shape, whereby it has a circular cross section centered on the longitudinal axis of body 12A. Outer surface portion 18A has two diametrically opposed drive projections 15A extending radially outwardly therefrom and adapted to contact the part to be driven by wrench 10A, said part having a cylindrical internal recess which conforms to outer surface portion 18A. As will be discussed more fully hereafter, drive projections 15A are sized so that they transmit the torque required for a good joint and, also, so that they will fail (i.e., break) if one attempts to overtorque the joint.

Wrench body 12A is provided with a shoulder 17A at one end which, as best shown in FIG. 3, has an annular shoulder face 19A extending radially outwardly of the outer surface portion 18A of wrench 10A. The face 19A serves to contact the part to be wrenched when the wrench body 12A is inserted in the internal recess thereof to thereby locate or position the wrench body 12A for the proper drive engagement cooperation with said part.

In FIG. 4 there is shown another embodiment of the invention which is essentially the same as the embodiment shown in FIG. 3 wherefore corresponding parts have been given the same reference numerals with primes added.

As is shown in FIGS. 3 and 4, wrench 10A' differs from wrench 10A in that the outer surface portion 18A' of wrench 10A' has two drive recesses 15A' instead of the drive projections 15A of wrench 10A. Thus, wrench 10A' comprises a body 12A' having a square internal hole 16A' providing four surfaces adapted to be driven by the wrench driver. Body 12A' also has a cylindrical outer surface portion 18A' having two diametrically opposed, radially inwardly extending recesses 15A' adapted to contact the part to be driven by wrench 10A' as will be described hereafter. There is also provided a shoulder 17A' in the proper drive-engaging position as discussed above. Internal whole 16A' and outer surface portion 18A' are centered on the longitudinal axis of body 12A'.

FIGS. 9 and 10 show the use of wrench 10A for driving an adapter fitting 20A which is similar to adapter fitting 20 except that it is provided with an internal wrenching surface of a different configuration. Thus, adapter fitting 20A has an internal wrenching surface 22A in the member 24A which is adapted to conform to the outer surface portion 18A and drive projections 15A provided on wrench 10A. To this end, member 24A has a wrenching surface comprising an internal cylindrical bore 22A adapted to slidably receive outer surface portion 18A and a pair of diametrically opposed recesses 25A adapted to slidably receive the drive projections 15A as is shown in FIGS. 9 and 10. Also, member 24A has a threaded end portion 26A for use in fastening the same to a positive seal threaded outlet connection of a flow component.

As stated above, drive projections 15A are sized to have a shear strength so that they transmit the torque required for a good joint and so that they world fail if the joint were overtorqued. Accordingly, wrench 10A is designed to function as a torque limiter while still employing the same elements as wrenches 10 and 10' Furthermore, because the wrench 10A is destroyed anytime the user would operate it improperly for a specific application, it brings immediate attention and control over what may be a dangerous practice in the use of wrench 10A.

Figure 11:
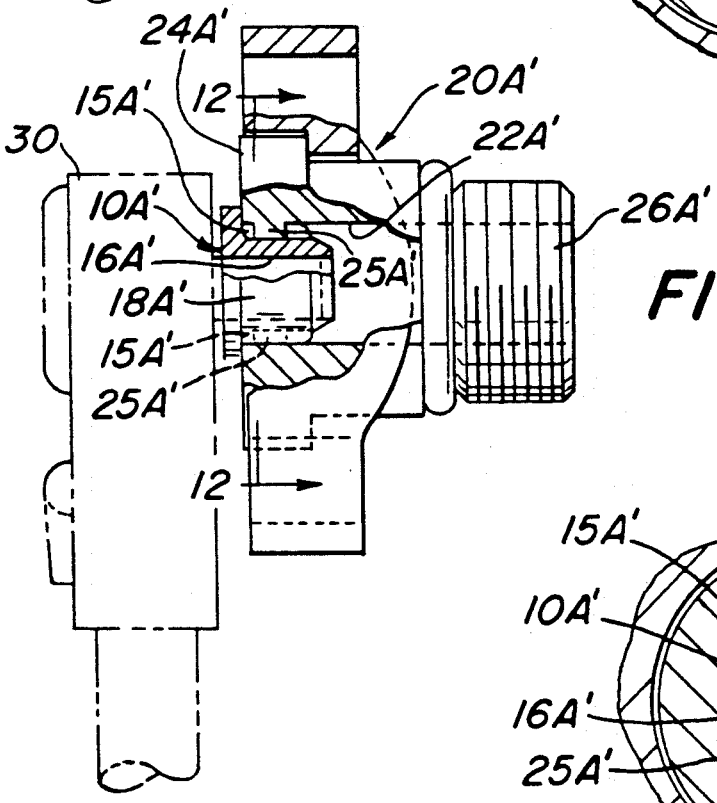
FIG. 11 is an elevational view illustrating the use of the internal wrench shown in FIG. 4.
Figure 12:
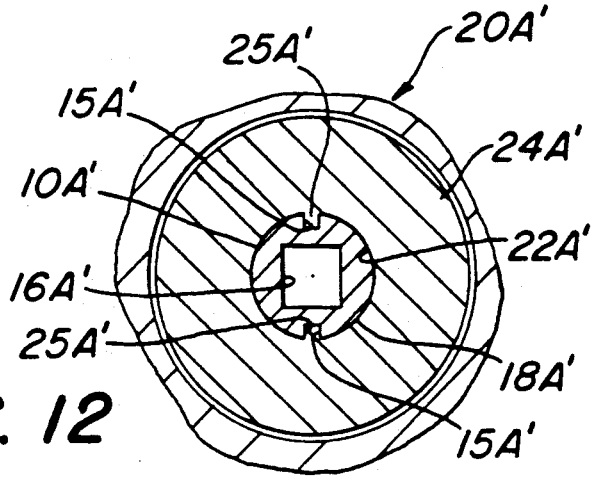
FIG. 12 is a sectional view taken on line 12—12 of FIG. 11.

FIGS. 11 and 12 show the use of the wrench 10A' for driving an adapter fitting 20A of a type similar to adapter fitting 20A. Adapter 20A' differs from adapter fitting 20A in that it has an internal wrenching surface in member 20A' which is adapted to conform to the outer surface portion 18A' and the recesses 15A'. To this end, member 24A' has an internal wrenching surface comprising an internal cylindrical bore 22A' adapted to slidably receive outer surface portion 18A' and a pair of diametrically opposed drive projections 25A' adapted to slidably receive recesses 15A', as shown in FIGS. 11 and 12. Wrench 10A, is designed and sized so that the outer drive portion provided by portion 18A' and recesses 15A' are of a strength so that they will shear off the internal driven projections 25A' formed on the driven member 24A' at the point when said member is properly torqued. Thus, projections 25A' are sized to have a shear strength so that they will shear off at the point when member 24A' has been torqued to the proper condition of tightness in its joint. By this arrangement, adequate tightening of member 24A' is assured and after the completion of the tightening, the resulting structure of the component provides an almost impossible, non-telltail disassembly arrangement.

The internal wrench in accordance with the invention has many advantages and features which will be apparent to those skilled in the art. The most important features are the lightweight design of the wrench, its compactness and its cost-effectiveness. Further, the positioning shoulder is an important feature in many applications. Further, the various wrenches disclosed can all be driven by standard power drivers, torque limiting drives, and torque wrenches and their respective extenders whereby the invention has many advantages over the prior art. Furthermore, when the internal wrenching of this invention is employed in fluid flow components of the type shown in my prior-mentioned patents and applications, it will assure the mechanical joining system's integrity and safety in a manner not taught or suggested by the prior art.

It will be apparent that various changes may be made in the construction and arrangement of parts without departing from the scope of the invention wherefore it is not desired to be limited except as required by the following claims.

What is claimed is:

1. An internal wrench for turning a part to be tightened, said part having an internal wrenching surface, comprising:

a wrench body having a longitudinal axis, said wrench body having an internal hole extending along said longitudinal axis, said internal hole having a polygon shape providing a plurality of inner surfaces centered on said longitudinal axis and adapted to be contacted by a driver for the wrench, said wrench body having an outer driving surface providing a plurality of outer surfaces adapted to contact the internal wrenching surface of said part for driving the same during wrenching, said wrench body including a shoulder formed at one end thereof, said shoulder extending radially outwardly of said outer surfaces of said wrench body for contacting the part to be wrenched to limit the insertion of said wrench body into the part's internal wrenching surface to thereby locate the wrench in a driving position, said inner surfaces of said internal hole having surface portions, both said surface portions of said inner surfaces of said internal hole and said outer surfaces of said driving surface extending axially from said shoulder at one end of said wrench body a substantial distance toward the other end of said wrench body to provide, respectively, surfaces to be contacted by a driver for the wrench and surfaces to contact the internal wrenching surface of said part for driving the same during wrenching, said surface portions of said inner surfaces being contained radially within said outer surfaces along a common portion of said longitudinal axis so as to be longitudinally coaxial therewith so that during the wrenching of a part by a driver in driving contact with said surface portions of said inner surfaces, wrenching forces are transmitted directly radially outwardly from said surface portions of said inner surfaces of said internal hole to said outer surface of said driving surface.

2. An internal wrench according to claim 1 wherein said internal hole of said wrench body has a rectangular configuration.

3. An internal wrench according to claim 2 wherein said outer surface of said wrench body has a hexagonal configuration.

4. An internal wrench according to claim 2 wherein said outer surface of said wrench body has a rectangular configuration.

5. An internal wrench according to claim 1 wherein said outer surface of said wrench body has a hexagonal configuration.

6. An internal wrench according to claim 1 wherein said internal hole of said wrench body is a through hole.

7. An internal wrench according to claim 1 wherein said outer surface of said wrench body has a cylindrical configuration having at least one radially outwardly extending drive projection.

8. An internal wrench according to claim 1 wherein said outer surface of said wrench body has a cylindrical configuration having at least two diametrically opposed, radially outwardly extending drive projections, said drive projections being sized so as to transmit a torque required for a good joint but to fail if the joint is overtorqued.

9. An internal wrench according to claim 1 wherein said outer surface has a cylindrical configuration having at least one radially inwardly extending recess.

10. An internal wrench according to claim 9 wherein there are provided at least two diametrically opposed radially inwardly extending recesses.

11. A method of internal wrenching a component of a mechanical joint that includes a part having an internal wrenching surface with the use of an internal wrench having a wrench body an internal hole extending on a longitudinal axis of the wrench body, said internal hole having a polygon shape providing a plurality of inner surfaces centered on said longitudinal axis and adapted to be contacted by a driver for the wrench, said wrench body having an outer driving surface providing a plurality of outer surfaces adapted to contact the internal wrenching surface of said part for the driving the same during wrenching, said wrench body including a shoulder formed at one end thereof, said shoulder extending radially outwardly of said outer surfaces of said wrench body for contacting the part to be wrenched to limit the insertion of said wrench body into the part's internal wrenching surface to thereby locate the wrench in a driving position, said inner surfaces of said internal hole having surface portions, said surface portions of said inner surfaces of said internal hole and said outer surfaces of said driving surface extending axially from said shoulder at one end of said wrench body a substantial distance toward the other end of said wrench body, said surface portions of said inner surfaces being contained radially within said outer surfaces along a common portion of said longitudinal axis so as to be longitudinal coaxial therewith so that during wrenching of a part by a driver in driving contact with said surface portions of said inner surfaces, wrenching forces are transmitted directly radially outwardly from said surface portions of said inner surfaces of said internal hole to said outer surfaces of said driving surface, said method of use comprising the steps of:

inserting said internal wrench into a wrenching position by placing said outer surfaces of said wrench body in driving contact with the internal wrenching surface of said part for driving the same during wrenching and by placing said shoulder of said wrench body in contact with said part to limit the insertion of the wrench body into the part's internal wrenching surface to thereby locate the wrench in a driving position, placing the drive portion of a drive wrench into driving contact with the internal surfaces of said internal hole of said wrench body, and causing a turning movement of the drive portion of the drive wrench to cause a corresponding turning of the internal wrench whereby wrenching forces are transmitted directly radially outwardly from said surface portions of said inner surfaces of said internal hole to said outer surfaces of said driving surface.

12. An internal wrench for turning a part to be tightened, said part having an internal wrenching surface, comprising:

a wrench body having a longitudinal axis, and firs and second body portions, said first body portion of said wrench body extending along a first portion of said longitudinal axis, said second body portion of said wrench body extending along a second portion of said longitudinal axis and being located at one end of said wrench body and adjacent to said first body portion of said wrench body, said wrench body having an internal hole extending along said longitudinal axis completely through said second body portion of said wrench body and at least partially within said first body portion of said wrench body, the portion of said internal hole extending within said first portion of said wrench body being adapted to be contacted by a driver for the wrench and having a polygon shape providing a plurality of inner surfaces centered on said longitudinal axis and extending along said first portion of said longitudinal axis, said first portion of said wrench body having an outer driving surface extending along said first portion of said longitudinal axis and providing a plurality of outer surfaces adapted to contact the internal wrenching surface of said part for driving the same during wrenching, said second portion of said wrench body including a shoulder extending radially outwardly of said outer surfaces of said wrench body for contacting the part to be wrenched to limit the insertion of said wrench body into the internal wrenching surface of said part to thereby locate the wrench in a driving position, said inner surfaces of said internal hole and said outer surfaces of said outer driving surface both extending along a common portion of said first portion of said longitudinal axis so that said inner surfaces are contained radially within said outer surfaces along said common portion of said first portion of said longitudinal axis so as to be in longitudinal coaxial relation so that during the wrenching of a part by a driver in driving contact with said surface portions of said inner surfaces, wrenching forces are transmitted directly radially outwardly from said inner surfaces of said internal hole to said outer surfaces of said outer driving surface.

13. An internal wrench according to claim 12 wherein said internal hole of said wrench body is a through hole.

14. An internal wrench according to claim 13 wherein said internal hole of said wrench body has a rectangular configuration and said outer surface of said wrench body has a hexagonal configuration.

* * * * *